US010519699B2

(12) United States Patent
Handke et al.

(10) Patent No.: US 10,519,699 B2
(45) Date of Patent: Dec. 31, 2019

(54) MOTOR VEHICLE LOCK WITH MICROSWITCH

(71) Applicant: Kiekert Aktiengesellschaft, Heiligenhaus (DE)

(72) Inventors: Armin Handke, Duisburg (DE); Milan Koubek, Pardubice (CZ)

(73) Assignee: Kiekert AG, Heiligenhaus (DE)

( * ) Notice: Subject to any disclaimer, the term of this patent is extended or adjusted under 35 U.S.C. 154(b) by 520 days.

(21) Appl. No.: 15/307,928

(22) PCT Filed: Apr. 30, 2015

(86) PCT No.: PCT/DE2015/000211

§ 371 (c)(1),
(2) Date: Dec. 23, 2016

(87) PCT Pub. No.: WO2015/165439

PCT Pub. Date: Nov. 5, 2015

(65) Prior Publication Data

US 2017/0130491 A1 May 11, 2017

(30) Foreign Application Priority Data

Apr. 30, 2014 (DE) ..... 10 2014 006 238

(51) Int. Cl.
*E05B 81/20* (2014.01)
*E05B 85/26* (2014.01)
(Continued)

(52) U.S. Cl.
CPC ..... *E05B 81/20* (2013.01); *E05B 15/04* (2013.01); *E05B 81/64* (2013.01); *E05B 81/66* (2013.01);
(Continued)

(58) Field of Classification Search
CPC ..... Y10T 292/699; E05B 81/68; E05B 2015/0444; E05B 81/64
See application file for complete search history.

(56) References Cited

U.S. PATENT DOCUMENTS 4,298,223 A * 11/1981 Raffelsiefer ..... E05B 85/26 292/216
4,593,945 A * 6/1986 Arute ..... F24C 15/022 292/201
(Continued)

FOREIGN PATENT DOCUMENTS

CN 101065553 10/2007
CN 101457609 6/2009
(Continued)

OTHER PUBLICATIONS

International Search Report and Written Opinion for corresponding Patent Application No. PCT/DE2015/000211 dated Aug. 28, 2015.

*Primary Examiner* — Mark A Williams
(74) *Attorney, Agent, or Firm* — Renner, Otto, Boisselle & Sklar, LLP

(57) ABSTRACT

The invention relates to a lock having a locking mechanism comprising a rotary latch and a pawl for locking the rotary latch in a locked position of the lock. An identification device for identifying a position of a moving component of the lock is provided. The identification device comprises a spring which is fitted to the component. The spring opens or closes an electrical circuit when the component and the spring which is connected to said component are moved. In this way, positions of the locking mechanism can be reliably determined, without having to worry about fatigue of the spring and associated problems.

16 Claims, 1 Drawing Sheet

Figure 1:
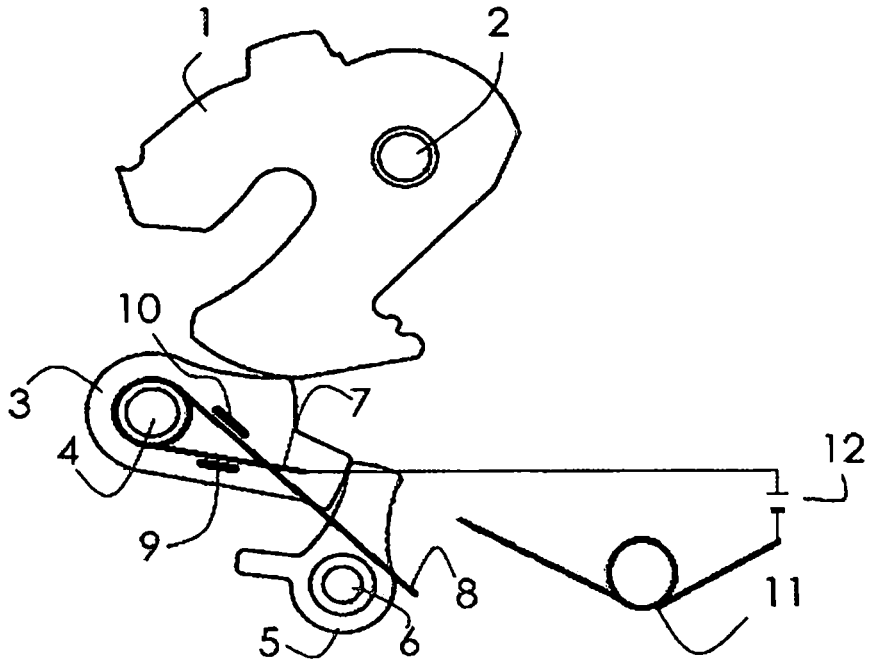

(51) Int. Cl.
*E05B 81/64* (2014.01)
*E05B 15/04* (2006.01)
*E05B 81/66* (2014.01)

(52) U.S. Cl.
CPC ..... *E05B 85/26* (2013.01); *E05B 2015/0444* (2013.01)

(56) References Cited

U.S. PATENT DOCUMENTS 4,969,343 A * 11/1990 Luker ..... E05B 39/025 292/229
5,419,305 A * 5/1995 Hanley ..... F24C 15/022 126/197
5,516,164 A * 5/1996 Kobayashi ..... E05B 81/20 292/201
2009/0151257 A1* 6/2009 Dominique ..... E05B 81/20 49/280
2011/0012375 A1* 1/2011 Graute ..... E05B 81/06 292/200
2011/0127780 A1* 6/2011 Barth ..... E05B 85/243 292/213
2013/0300134 A1* 11/2013 Jayasuriya ..... E05B 77/08 292/129
2014/0159394 A1* 6/2014 Promutico ..... D06F 37/28 292/341.16

FOREIGN PATENT DOCUMENTS

DE 10330194 1/2005
DE 102004030902 1/2006
DE 102005048564 4/2007
DE 20 2008 005016 U1 8/2009
DE 10 2009 026 921 A1 12/2010
DE 102014006238 11/2015
EP 1 493 888 A1 1/2005
WO WO-2006000190 A1 * 1/2006 ..... E05B 85/26
WO 2010/142280 A1 12/2010

* cited by examiner

MOTOR VEHICLE LOCK WITH MICROSWITCH

The invention relates to a latch for a motor vehicle with a locking mechanism comprising a catch and a pawl, with which the catch can be latched in a closed position. The latch comprises a detection device for detection of a position of a component of the locking mechanism.

As can be found in publication DE 10 2009 026 921 A1, the catch of a motor vehicle latch has a fork-shaped inlet slot, also known as an infeed section, into which a locking bolt, also known as a latch holder, of a motor vehicle door or motor vehicle flap enters when the motor vehicle door or motor vehicle flap is closed. The locking bolt then rotates the catch from an open position to a closed position. If the catch has reached a closed position, the locking bolt can no longer leave the inlet slot of the catch. In such a closed position, a pawl latches the catch. Consequently, it can no longer be rotated back into the opening position.

DE 10 2009 026 921 A1 further teaches the provision of detection devices in the form of microswitches arranged laterally in respect to pawls which can be activated by lateral contour areas of pre-ratchet pawls and/or main ratchet pawls. The position of the respective pawl can be ascertained by activation of the microswitches in order to control a closure aid, with which the locking mechanism can be shifted automatically from a pre-ratchet position to a main ratchet position.

If such a microswitch is activated, a generally already pre-tensioned spring of the microswitch is further pre-tensioned and stressed accordingly. A return movement occurs in the case of relief due to the pre-tensioning of the spring. If such a microswitch is positioned in the activated and thus in the stressed state, signs of fatigue can occur on the spring. This can lead to malfunctions.

It is the task of the invention to further develop a latch of the aforementioned type in which the position of a component of the locking mechanism can be reliably and durably indicated.

The task of the invention is solved by a latch with the characteristics of the first claim. Advantageous designs arise from the sub claims. Insofar as not stated to the contrary hereinafter, a latch according to the claim can also demonstrate the characteristics stated at the start, individually or in any combination.

In order to solve the task, a latch with a locking mechanism consisting of a catch and a pawl for a latching of the catch in a closed position of the latch with a detection device for detection of a position of a moving component of the latch is provided. The detection device comprises a spring attached to the component. The spring opens or closes an electrical circuit when the component and the connected springs are moved.

In contrast to a microswitch, the movement from a pre-tensioned state of the spring does not occur by tension or spring force, but by movement of the component. Spring fatigue signs which can cause malfunctions are thus prevented. Spring fatigue is also avoided because the spring does not need to be permanently pre-tensioned.

The closure or opening of the electrical circuit indicates the position of the spring and thus the position of the moving component. The direct or indirect consequence of the closure or opening of the electrical circuit can also be that an electrical drive is set in motion or an electrical drive started up is stopped. The closure or opening of the electrical circuit can directly or indirectly cause a light to be switched on or off. The closure or opening of the electrical circuit can activate an electrical or electronic control device.

The electrical circuit is preferably not closed when the pertaining door or flap is closed. The door or flap is generally not closed on a motor vehicle. If the electrical circuit is not closed, no spring is pre-tensioned which is part of the detection device. The spring is therefore advantageously generally not pre-tensioned in this design. The detection device is then especially durable and reliable.

In one design of the invention, the movable component is a pawl with which the catch can be latched. The position of the pawl can then be detected with the detection device. It can thus be ascertained, for example, whether the catch is latched.

Alternatively or additionally, further moving components of the locking mechanism can include such a spring of a detection device, thus, for example, the catch or a blocking lever of the locking mechanism.

In one design of the invention, the spring is held by the axis of the movable component. The axis thus assumes a dual function which enables a simple and space-saving construction.

In one design of the invention, one or several bridges are attached to the movable component by means of which the spring is held. This enables a simple and space-saving construction.

In one design of the invention, the electrical circuit is closed by a spring leg being moved against another spring leg and touching it. In the closed state of the electrical circuit both spring legs are preferably pre-tensioned in order to close the electrical circuit with particular reliability.

Further advantages and designs of the invention are illustrated by the following execution example. The following additionally described characteristics constitute advantageous designs which can be combined individually or in combination with the stressed object.

Figure 2:
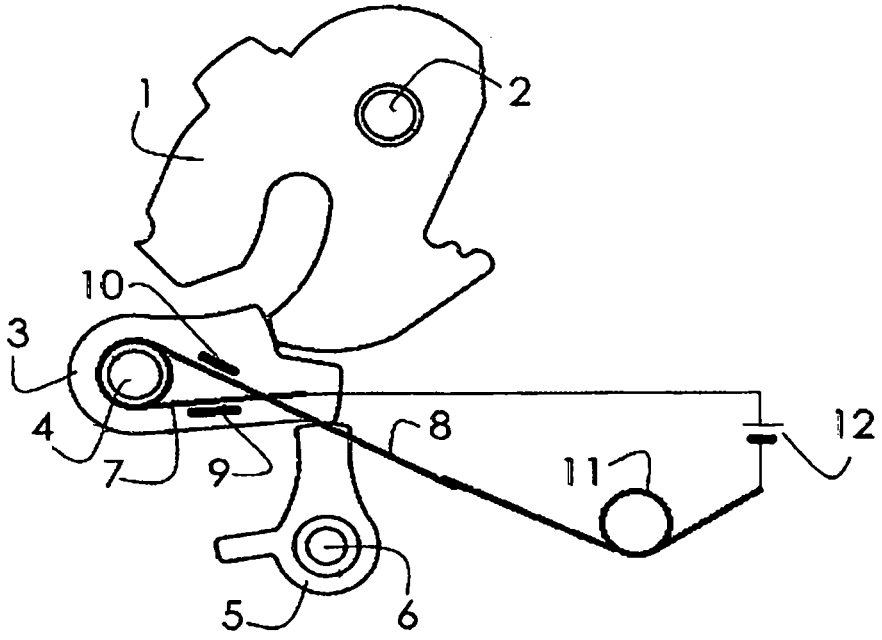

The following are shown:

FIG. 1: Locking mechanism in the open state;

FIG. 2: Locking mechanism in the closed state.

FIGS. 1 and 2 show a catch 1, which can be rotated or pivoted around its axis 2. The catch 1 can be latched by means of a pawl 3. The catch 3 can be pivoted around its axis 4. This locking mechanism further encompasses a blocking lever 5 which can be pivoted around its axis 6.

A spring with spring legs 7 and 8 is held in the area of the pawl axis or by the pawl axis 4 and bridges 9 and 10 of the pawl 3. The bridges 9 and 10 are attached on the surface of the pawl 3. These can be angular or bent in profile in order to encompass and thus hold the spring legs 9 and 10. There is also a spring 11. Both springs 7, 8 and 11 are connected to a direct current source 12.

FIG. 1 shows the locking mechanism in the unlatched state. The pawl 3 abuts a contour of the catch 1 without latching it. The blocking lever 5 abuts a contour of the pawl 3 without blocking the pawl 3. The spring leg 8 is electrically disconnected from the spring 11. The electrical circuit, which is supplied with voltage via the power source, is therefore not closed.

If the catch 1 is rotated by a non-illustrated locking bolt of a door or a flap from its open position according to FIG. 1 into its closed position according to FIG. 2, the pawl 3 thus finally moves into its ratchet position as shown in FIG. 2. The blocking lever 5 then moves into its blocking position as shown in FIG. 2. The locking mechanism is now latched.

Due to the pivoting movement of the pawl 3 the spring leg 8 has moved in the direction of the spring 11 and touches it in the latched state of the locking mechanism as shown in FIG. 2. Both springs are then preferably pre-tensioned. The electrical circuit is now closed. The closure of the electrical circuit displays that the locking mechanism has been latched. The closure of the electrical circuit can, for example, be used to supply a non-illustrated consumer with electricity thus for example a drive to latch the locking mechanism. In one design of the invention, the closure of the electrical circuit can be used to move the locking mechanism, if initially only latched into a pre-ratchet position by an electrical drive into its main ratchet position and latch it there, the locking mechanism or the door is closed.

In one design of the invention a control device can be provided for as a consumer which is activated as soon as the electricity circuit is closed. The control device can activate the desired processes as soon as it is supplied with power.

Vice versa, a pivoting of the pawl 3 into its ratchet position can cause the electricity circuit to be opened. If the locking mechanism is latched, the electricity circuit is closed. This can be used to activate internal lighting, for example.

REFERENCE SIGN LIST

1: Catch
2: Catch axis
3: Pawl
4: Pawl axis
5: Blocking lever
6: Blocking lever axis
7: Spring leg
8: Spring leg
9: Bridge
10: Bridge
11: Spring
12: Power source

The invention claimed is:

1. A latch comprising:

a locking mechanism having a catch and a moving component that is movable between an unratcheted position and a ratcheted position for latching of the catch in a closed position of the latch, a detection device for detection of a position of the moving component of the latch, wherein the detection device includes a first spring attached to the moving component, and a second spring, and an electrical power circuit, wherein the first spring and the second spring are connected to the electrical power circuit, wherein the first spring is moveable with the moving component to disconnect and connect to the second spring by disengaging and engaging the second spring, respectively, to open and close the electrical power circuit, respectively, when the moving component is moved between the unratcheted position and the ratcheted position, wherein the first spring of the detection device, in a closed state of the electrical power circuit, abuts the second spring in a pre-tensioned state.

2. The latch according to claim 1, wherein the moving component is a pawl or a blocking lever.

3. The latch according to claim 1, wherein the first spring of the detection device is held by an axis of the moving component.

4. The latch according to claim 1, wherein the first spring of the detection device is held by one or several bridges of the moving component.

5. The latch according to claim 1, wherein in a latched state of the locking mechanism, the electrical power circuit is open.

6. The latch according to claim 1, wherein a closure aid is activated by closing the electrical power circuit which is capable of moving the locking mechanism from a pre-ratchet position into a main ratchet position.

7. The latch according to claim 1, wherein one of the first spring and the second spring is attached to the catch.

8. The latch according to claim 1, wherein the electrical power circuit includes a power source to which both the first spring and the second spring are connected.

9. The latch according to claim 8, wherein the power source is a direct current source.

10. The latch according to claim 4, wherein the one or several bridges of the moving component are angular or bent.

11. The latch according to claim 4, wherein the one or several bridges of the moving component are arranged on a face surface of the moving component.

12. The latch according to claim 4, wherein the first spring has spring legs that engageable with the one or several bridges of the moving component.

13. The latch according to claim 12, wherein the first spring has a first set of spring legs that are engageable with the one or several bridges of the moving component and another spring leg that is connectable with the second spring.

14. The latch according to claim 1, wherein the second spring is detached relative to the catch and the moving component.

15. A latch comprising:

a locking mechanism having a catch and a moving component that is movable between an unratcheted position and a ratcheted position for latching of the catch in a closed position of the latch, a detection device for detection of a position of the moving component of the latch, wherein the detection device includes a first spring attached to the moving component, and a second spring, wherein the first spring of the detection device is held by an axis of the moving component, and an electrical power circuit, wherein the first spring and the second spring are connected to the electrical power circuit, wherein the first spring is moveable with the moving component to disconnect and connect to the second spring by disengaging and engaging the second spring, respectively, to open and close the electrical power circuit, respectively, when the moving component is moved between the unratcheted position and the ratcheted position.

16. A latch comprising:

a locking mechanism having a catch and a moving component that is movable between an unratcheted position and a ratcheted position for latching of the catch in a closed position of the latch, a detection device for detection of a position of the moving component of the latch, wherein the detection device includes a first spring attached to the moving component, and a second spring, wherein one of the first spring and the second spring is attached to the catch, and an electrical power circuit, wherein the first spring and the second spring are connected to the electrical power circuit, wherein the first spring is moveable with the moving component to disconnect and connect to the second spring by disengaging and engaging the second spring, respectively, to open and close the electrical power circuit, respectively, when the moving component is moved between the unratcheted position and the ratcheted position.

* * * * *